US008303799B2

(12) United States Patent
Yamamoto et al.

(10) Patent No.: US 8,303,799 B2
(45) Date of Patent: Nov. 6, 2012

(54) PROCESS AND APPARATUS FOR GRINDING WITH ELECTROLYTIC DRESSING

(75) Inventors: Yasutaka Yamamoto, Tokyo (JP); Jiro Maruyama, Tokyo (JP); Masaoki Shimano, Tokyo (JP)

(73) Assignee: Fuji Jukogyo Kabushiki Kaisha, Tokyo (JP)

( * ) Notice: Subject to any disclaimer, the term of this patent is extended or adjusted under 35 U.S.C. 154(b) by 1201 days.

(21) Appl. No.: 11/882,403

(22) Filed: Aug. 1, 2007

(65) Prior Publication Data

US 2008/0057835 A1 Mar. 6, 2008

(30) Foreign Application Priority Data

Aug. 31, 2006 (JP) ..... 2006-236008

(51) Int. Cl.
*B23H 3/00* (2006.01)

(52) U.S. Cl. ..... 205/662; 204/224 M; 205/766

(58) Field of Classification Search ..... 204/224 M; 205/662, 766

See application file for complete search history.

(56) References Cited

U.S. PATENT DOCUMENTS

| | | | | |
|---|---|---|---|---|
| 4,367,389 | A * | 1/1983 | Inoue | 219/69.17 |
| 4,907,374 | A * | 3/1990 | Brill | 451/342 |
| 5,620,358 | A * | 4/1997 | Furukawa et al. | 451/22 |
| 6,244,939 | B1 | 6/2001 | Ohmori et al. | |
| 6,547,648 | B1 * | 4/2003 | Zhu et al. | 451/49 |

FOREIGN PATENT DOCUMENTS

| | | | |
|---|---|---|---|
| DE | 33 12 604 A1 | | 10/1984 |
| DE | 3312604 A1 | * | 10/1984 |
| DE | 10042613 | | 5/2001 |
| JP | 01188266 A | * | 7/1989 |
| JP | 01-143346 | | 10/1989 |
| JP | 01143346 U | * | 10/1989 |
| JP | 03065256 A | * | 3/1991 |
| JP | 4-35869 | | 2/1992 |
| JP | 6-91437 | | 4/1994 |
| JP | 7-96462 | | 4/1995 |
| JP | 2838314 | | 10/1998 |
| JP | 2001-62721 | | 3/2001 |

OTHER PUBLICATIONS

German Office Action (with translation) issued in corresponding German Application No. 10 2007 038 050.1 dated Jun. 18, 2008.

"Abc des Honens", Sonderdruck Deutsche Verlags-Anstalt GmbH, 1968, 12 pages.

Japanese Office Action issued on Sep. 20, 2011 for Application No. 2006-236008 (with partial translation).

* cited by examiner

*Primary Examiner* — Nicholas A. Smith

(74) *Attorney, Agent, or Firm* — Smith, Gambrell & Russell, LLP

(57) ABSTRACT

A process for grinding workpieces is obtained which includes attaching honing stones to a tool, each of the honing stones including grinding particles and an electroconductive connection for fixing the grinding particles to each other; grinding the workpieces with the honing stones by applying a honing liquid having substantially no electroconductive property to a region between the workpiece and the honing stones, the workpieces being successively ground during a series of processing periods, while interposing non-processing periods between the processing periods, each of the workpieces being ground in one of the processing periods; and performing an electrolytic dressing with respect to the honing stones by using an electrode provided to face the honing stones with a space therebetween, a voltage being applied between the honing stones and an electrode in the presence of an electroconductive liquid in the space between the honing stones and the electrode, the electrolytic dressing being carried out during the non-processing periods.

20 Claims, 9 Drawing Sheets

(I)

Prior Art

Prior Art

Prior Art

PROCESS AND APPARATUS FOR GRINDING WITH ELECTROLYTIC DRESSING

CROSS REFERENCE TO RELATED APPLICATIONS AND INCORPORATION BY REFERENCE

This application is based upon and claims the benefit of priority from the prior Japanese Patent Application No. 2006-236008, filed on Aug. 31, 2006; the entire content of which is incorporated herein by reference.

BACKGROUND OF THE INVENTION

1. Field of the Invention

The present invention relates to a process and apparatus for grinding a workpiece and applying an electrolytic dressing to honing stones.

2. Discussion of the Related Art

For dressing an inner surface of a cylindrical workpiece such as a cylinder bore for an automobile, a high degree of precision is required. For this purpose, honing treatment by using a honing apparatus is applied to the workpiece. By the honing treatment, it is possible to efficiently improve treatment precision, such as degrees of roundness, straightness and roughness with respect to an inner surface of a cylinder wall or the like which had been treated by fine boring and grinding.

The honing apparatus includes a honing tool including honing stones (grinding wheels) in the form of radially arranged rectangular rods. Therein, the honing stones impart a contact pressure to an inner surface of a cylindrical workpiece to grind in an external direction with respect to the diameter of the workpiece. Therefore, the workpiece is subjected to grind dressing by the reciprocating rotation of the honing tool over the entire length of the workpiece.

When a honing treatment is carried out by the honing apparatus, the honing stones rotate reciprocatingly in circumferential direction and move in a lengthwise directions of the cylindrical workpiece, simultaneously (hereinafter, referred to as rotational reciprocating movement). As a result, a ground trace in the form of a special net, that is referred to as a cross-hatch pattern, is formed on the surface of the workpiece. The cross-hatch pattern functions to store lubricating oil therein, which is necessary for a cylinder bore of an engine.

Generally speaking, each of the honing stones is in the form a rectangular rod made of extremely rigid and small grinding particles such as aluminum oxide and silicone carbide, with the particles being connected by a bonding agent. Honing stones, which have excellent autogenetic properties, that is, self-dressing properties (phenomenon of fresh grinding particles emerging after worn and flattened grinding particles fall off) while grinding a workpiece, are used.

Even with selecting the excellent honing stones, the processing precision of the workpiece varies depending on the autogenic property of the material. The autogenic cycles of the honing stones are affected, for example, by different processing preciseness of workpieces that had been treated in a previous treatment, such as fine boring and grinding, different shapes of the honing stones due to the fabrication of the honing stones, and contamination of the honing liquid used in the honing treatment.

When the autogenic phenomenon of the honing stones is not uniformly attained over the surface of the stones, it is possible that some shortcomings occur. Namely, it is possible that grinding dust/residue is pressed into gaps formed on the surfaces of the honing stones (loading/clogging), the original uneven surface of the grinding particles is worn and flattened without falling-off of the worn grinding particles (flattening/dulling), and the grinding particles fall off even with a slight grinding resistance or impact (shedding), the roughness of the treating surface is decreased, the treating surface is tempered by grinding, and the honing stones are damaged by cracking during the grinding operation. Moreover, the processing time can be excessively long lengthened. Accordingly, it is necessary to apply a dressing treatment frequently to the honing stones.

Many kinds of dressing measure for dressing stones are proposed. For example, FIG. 7 shows that a honing stone-dressing member 103 is supported at a position above a workpiece W. The dressing member 103 is in the form of a hollow cylinder and integral with an insertion guide 102 which is also in the form of a hollow cylinder. The insertion guide 102 is used for introducing a honing tool 105 in the workpiece W, so that the honing tool 105 is surrounded by the cylindrical inner surface Wa of the workpiece W. Honing treatment is applied to the workpiece W by a rotational member 101. The inner diameter of the dressing member 103 and the processing diameter of the honing stones 106 of the honing tool 105 are prepared to be approximately the same, and then the dressing stones 104 are provided inside of the dressing member 103.

The inner surface Wa of the workpiece W in the form of a cylinder is subjected to a horning treatment by using the honing tool 105. The insertion guide 102 and the dressing member 103 are caused to rotate by the rotational member 101, at an appropriate time for dressing. Then, the horning tool 105 is inserted into a dressing member 103 for thrusting out the honing stones 106 in a radial direction. Accordingly, the honing stones 16 project outwardly to contact the dressing stone 104. The honing tool 105 in this state makes a rotational reciprocating movement. It is disclosed in Japanese Kokai Publication 07 (1995)-096462 that the honing stones 106 are subjected to dressing with the honing stone 106 maintained on the honing tool 105, by the rotational reciprocating movement.

On the other hand, a metal bond wheel is frequently used, which is obtained by combining honing stones with grinding particles via an electroconductive connection made of bronze or cast iron. As dressing processes for such honing stones, various electrolytic dressing methods are proposed.

For example, FIG. 8 shows that a stone holder 112 for electrolytic dressing is provided on a honing head 111. A honing stone 115 made of grinding particles and an electroconductive connection is provided on the honing holder 112. In this state, an electrode 113 is provided closely to a processing surface, that is, an outer surface of the honing stone 115 situated at a predetermined position by the honing holder 112. The electrode 113 has a surface 113*a* (opposing surface 113*a*) having a cross section in the form of a circular arc. The opposing surface 113*a* opposes the outer surface of the honing stone 113 having a predetermined space therebetween. To the opposing surface 113*a*, an electroconductive honing liquid such as an aqueous coolant is supplied through a channel 113*b*. Furthermore, a voltage application member 114 is provided between the honing stone 115 and the electrode 113. By this apparatus, the application of predetermined voltage between the honing stone 115 and the electrode 113 is carried out simultaneously with the application of electroconductive honing liquid to a portion between the honing stone 115 and the electrode 113. Thus, the electrolytic dressing process is performed by electrolyzing the electroconductive connection on the outer surface of the honing stone 115 for causing the grinding particles to protrude from the outer surface of the honing stone 115. This type of electrolytic dressing method is known from Japanese Kokai Publication 2001-62721.

Japanese Patent No. 2838314 discloses a method for alternately performing electrolytic dressing and honing treatments. For carrying out this method, a workpiece 122 is provided on a rotatable chuck 121 on a processor, and a metal bond wheel 125 is provided on a shuck (not shown) which faces the workpiece 122 and makes a rotational reciprocating movement. An electrode 124 is also used, which has an electrode surface 124*a* facing the wheel 125, and a honing liquid supply opening 124*b*. A predetermined voltage is generated between the wheel 125 and the electrode 124 while the wheel 125 rotates in back and forth directions at a position between the workpiece 122 and the electrode 124. Simultaneously, an electroconductive liquid such as a coolant is supplied from the honing liquid supply opening 124*b* to a space between the wheel 125 and the electrode 124. In this way, electrolytic dressing and honing treatments are alternatively carried out.

Japanese Kokai Publication 07 (1995)-096462, however, has a structure that positions of the dressing member 103 and the insertion guide 102 are exchanged, for carrying out dressing of the honing stones 106 after grinding the workpieces. Therefore, an additional step, that is, to the positions of the insertion guide 102 and the dressing member 103 is required before the dressing treatment of the honing stones 106. Accordingly, the entire length of the honing cycle is increased, and hence it is possible the long operation time would affect the efficiency of the honing treatment. Moreover, it is not possible to judge the dressing state and the dressing timing without measuring the processing precision of the workpiece. Therefore, it is difficult to apply this method to a continuously operated mass-production system.

In Japanese Kokai Publication 2001-62721, it is necessary to provide a honing holder 112 to the honing head 111, and honing stones 115 to the honing holder, for dressing operation of the honing stones 115. Here, in place of the honing tool, a the honing holder 112 for electrolytic dressing is installed on the honing head 112, and the honing stones 115 detached from the honing tool is provided on the honing holder 112. Moreover, the honing stones 115, which have been subjected to a dressing treatment, are provided on the honing tool again, and the honing holder 112 detached from the honing head 111 is returned to the honing tool. Accordingly, complex operation is necessary to use the apparatus, and many operational steps are included for applying dressing treatment to the honing stones 115. That makes the honing cycle long, and the efficiency of the honing operation could be decreased.

In addition to the above, it is necessary based on the art disclosed in Japanese Patent No. 2838314 that for alternately performing electrolytic dressing and honing treatments. This alternate performance is carried out by generating a predetermined voltage between the metal bond wheel 125 and the electrode 124 during the rotational reciprocating movement of the wheel 25 between the workpiece 122 and the electrode 124, which is carried simultaneously with the supply of the electroconductive liquid such as a coolant to a space between the wheel 125 and the electrode 124. When a dressing grinding treatment is carried out by using a honing liquid with a small electroconductive or a substantially no electroconductive property, it is only possible to obtain a slight electric current in the grinding liquid, and hence it is possible that the electric current by the electrolytic dressing is unstable or non-available. Accordingly, it is possible that the electrolytic dressing capability is considerably decreased or lost.

OBJECT AND SUMMARY OF THE INVENTION

It is therefore an object of the present invention to provide a process for efficiently and stably performing grinding operations with respect to workpieces to produce products having excellent quality, with performing electrolytic dressing operation to honing stones in a short period between the grinding operations for eliminating an excessive abrasion of the honing stones.

The above object of the present invention is attained by a process for grinding workpieces, comprising attaching honing stones to a tool, each of the honing stones comprising grinding particles and an electroconductive connection for fixing the grinding particles to each other; grinding the workpieces with the honing stones by applying a honing liquid having substantially no electroconductive property such as an oily coolant to a region between the workpiece and the honing stones, the workpieces being successively ground during a series of processing periods, while interposing non-processing periods between the processing periods, each of the workpieces being ground in one of the processing periods; and performing an electrolytic dressing with respect to the honing stones by using an electrode provided to face the honing stones with a space therebetween, a voltage being applied between the honing stones and an electrode in the presence of an electroconductive liquid, preferably an aqueous coolant in the space between the honing stones and the electrode, the electrolytic dressing being carried out during the non-processing periods.

The above object of the present invention is also attained by a process for grinding workpieces, comprising providing an apparatus comprising a tool provided with honing stones, each of the honing stones comprising grinding particles and a connection for fixing the grinding particles to each other; a processing unit including a workpiece support for supporting the workpieces, and a honing liquid supply member for supplying a honing liquid having substantially no electroconductive property such as an oily coolant; and an electrolytic dressing unit including a vessel for storing an electroconductive liquid, preferably an aqueous coolant, an electrode and a voltage application member, the electrode and the voltage application member provided in the vessel and facing each other with a space therebetween, the voltage application member applying a voltage to the honing stones; grinding the workpieces with the honing stones by applying a honing liquid having substantially no electroconductive property to a region between the workpiece and the honing stones, the workpieces being successively ground during a series of processing periods in the processing unit, the processing periods interposing non-processing periods therebetween, each of the workpieces being ground in one of the processing periods; and performing an electrolytic dressing with respect to the honing stones by applying a voltage between the honing stones and the electrode in the presence of the electroconductive liquid in the space between the honing stones and the electrode, the electrolytic dressing being carried out during the non-processing periods in the electrolytic dressing unit.

When the aqueous coolant is used as the electroconductive liquid, it is easy to perform the present invention because of the availability. Further, the honing tool is not adversely affected by the use of the coolant.

Another object of the present invention is to provide an apparatus for efficiently and stably performing grinding operations with respect to workpieces to produce products having excellent quality, with performing electrolytic dressing operation to honing stones in a short period between the grinding operations for eliminating an excessive abrasion of the honing stones.

The above object of the present invention is attained by an apparatus for grinding workpieces, comprising a tool provided with honing stones, each of the honing stones comprising grinding particles and a connection for fixing the grinding particles to each other; a processing unit including a workpiece support for supporting the workpieces, and a honing liquid supply member for supplying a honing liquid with substantially no electroconductive property such as an oily coolant, the workpieces being ground by the honing stones by applying the honing liquid to a region between the workpiece and the honing stones, the workpieces being successively ground during a series of processing periods in the processing unit, the processing periods interposing non-processing periods therebetween, each of the workpieces being ground in one of the processing periods; and an electrolytic dressing unit including a vessel for storing an electroconductive liquid, preferably an aqueous coolant, an electrode and a voltage application member, the electrode and the voltage application member provided in the vessel and facing each other with a space therebetween, the voltage application member applying a voltage to the honing stones, an electrolytic dressing being performed with respect to the honing stones by applying a voltage between the honing stones and the electrode in the presence of the electroconductive liquid in the space between the honing stones and the electrode, the electrolytic dressing being carried out during the non-processing periods in the electrolytic dressing unit.

It is preferable that the apparatus for grinding workpieces further comprises a processing period measuring member for measuring the lengths of the processing periods, the electrolytic dressing being applied to the honing stones when the processing period measuring member detects that the lengths of the processing periods reach a predetermined threshold value. By using the process period measuring member, excellent products which have been satisfactory ground can be obtained since it is possible to prevent the honing stones from an excessive abrasion. Eventually, the processing period can be shortened because the honing stones with a good grinding capability are always used.

It is also preferable that the electrolytic dressing is performed once after a predetermined number of the non-processing period has elapsed. By this measure, it is possible to stably maintain a satisfactory grinding capability, and products having a stable quality can be obtained.

In addition to the above, it is preferable that the tool is a honing tool including a rotatable honing tool main body configured to be supported by a vertically movable honing head, and the honing stones are configured as radially arranged rectangular rods provided on an outer peripheral surface of the main body; and the electrode configured as a hollow cylinder to receive the honing head main body and the honing stones therein when the honing tool main body is moved downwardly by the support of the honing head, the honing stones facing a cylindrical surface of the electrode with a predetermined space extending from the honing stones to the cylindrical surface.

It is also preferable that the honing tool further comprises honing shoes and a bar for pressing the honing stones outwardly, the honing tool main body being configured as a hollow cylinder having a cylindrical wall extending along the central axis of the honing tool, an upper part of the honing tool main body being configured to be supported by the honing head, the honing tool main body having a plurality of honing shoe guide openings in the cylindrical wall, the openings penetrating the cylindrical wall and radially extending when viewed from and end of the main body, and also vertically extending along the entire length of the central axis of the honing tool, the honing shoes configured to fit in the openings in the cylindrical wall of the honing tool main body respectively and being sidable therein in radial directions, the honing stones being provided on outer surfaces of the honing shoes, the bar pressing the honing shoes outwardly so as to move away from the central axis of the honing tool.

In the above apparatus, it is preferable that the honing tool main body is made of an iron material. The main body made of iron material is widely applicable to the generally used honing tools made of iron, and can be manufactured economically.

It is also preferable that the honing shoes in the apparatus of the present invention are made of stainless steel. The rust development in the course of the electrolytic dressing of the honing shoes can be restricted by using the honing shoes made of stainless steel. As a result, the smooth movement of the honing shoes with respect to the honing shoe guide openings can be maintained without deterioration by the rust development.

BRIEF DESCRIPTION OF THE DRAWINGS

A more complete appreciation of the invention and many of the attendant advantages thereof will be readily perceived as the same becomes better understood by reference to the following detailed description when considered in connection with the accompanying drawings, wherein.

DETAILED DESCRIPTION OF THE INVENTION

Other features of this invention will become apparent in the course of the following description of exemplary embodiments, which are given for illustration of the invention and are not intended to be limiting thereof.

Exemplary embodiment of the invention as to a process and apparatus for grinding a workpiece and applying an electrolytic dressing to honing stones will now be explained in detail, by referring to a honing treating method and a honing apparatus shown in FIGS. 1 to 6.

Figure 1:
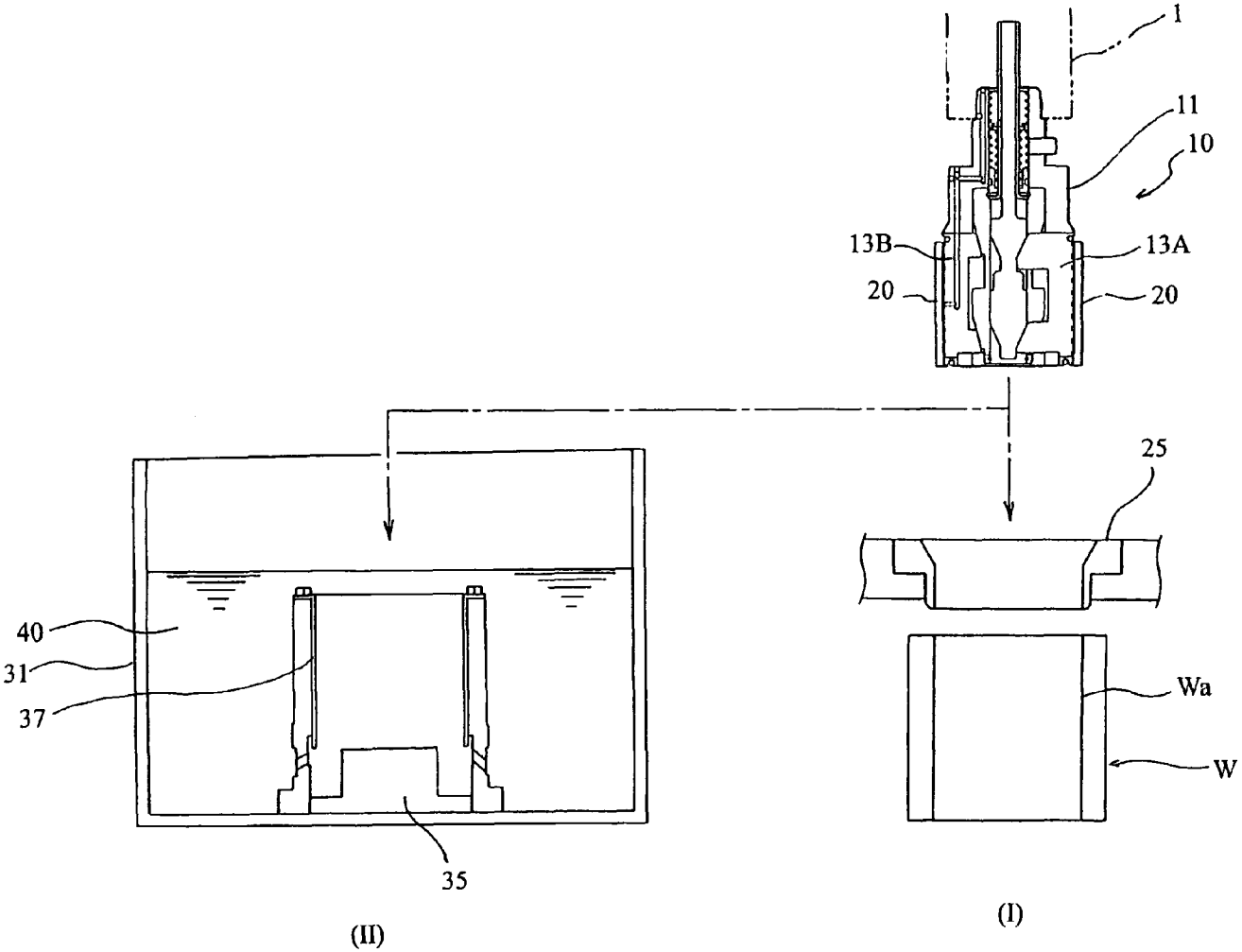
FIG. 1 is a schematic diagram for explaining a grinding apparatus according to the present invention.
Figure 2:
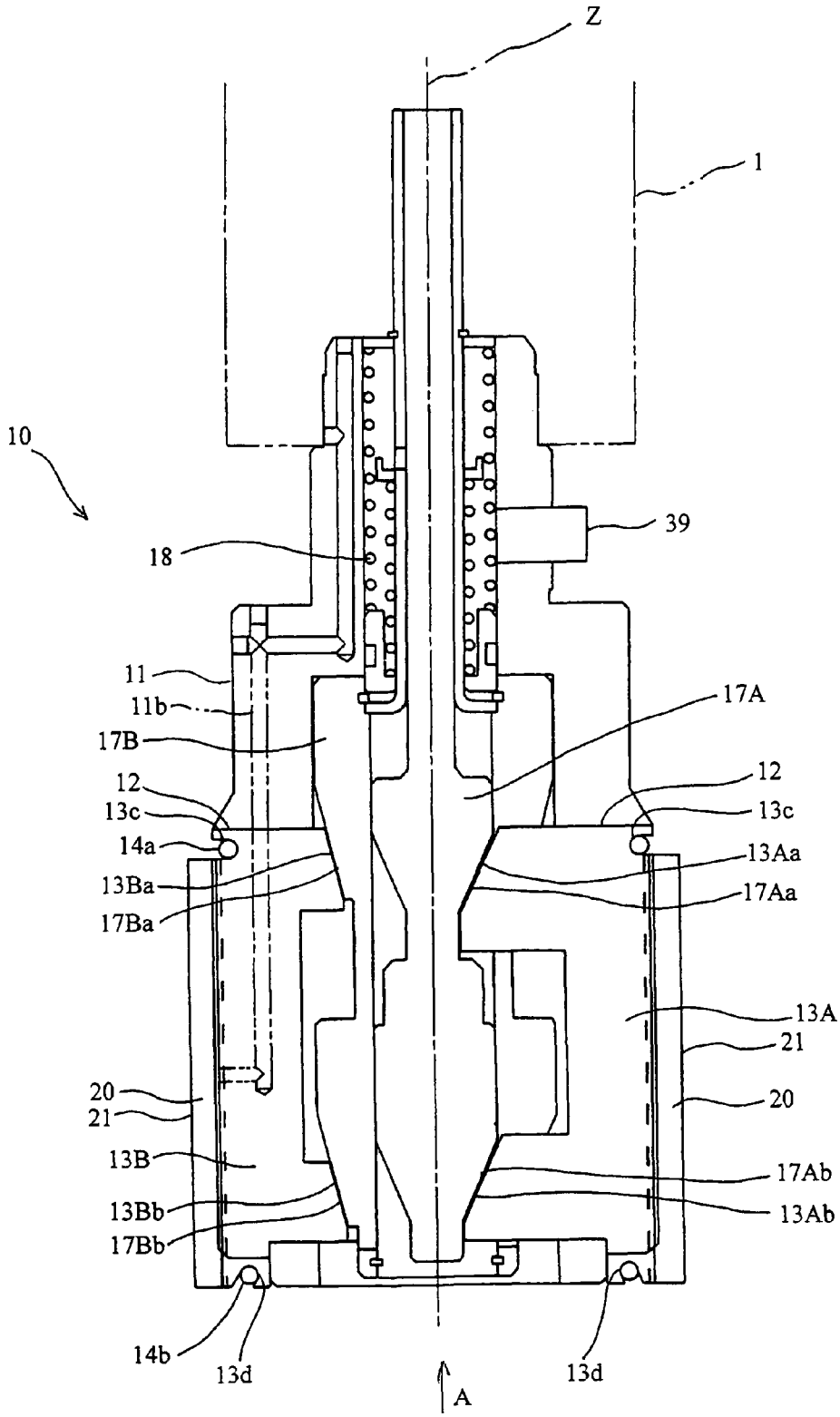
FIG. 2 is schematic diagram of a honing tool.

FIG. 1 is a schematic diagram of a honing apparatus, and FIG. 2 is a diagram for showing a structure of a honing tool 10. As shown in FIGS. 1 and 2, the honing tool 10 is suspended from a honing head 1 so as to be rotatable. The honing head 1 is a driving unit including a spindle motor or the like. The honing tool 10 is supported on the honing head 1 so as to be movable in a vertical direction, and also rotatable around a perpendicular central axis Z. The honing head 1 and the honing tool 10 move between a processing unit I and a dressing unit II as shown in FIG. 1. In the processing unit, grinding, i.e., a honing treatment is applied to a workpiece, such as a cylinder bore for an engine, having a cylindrical inner wall Wa.

Figure 3:
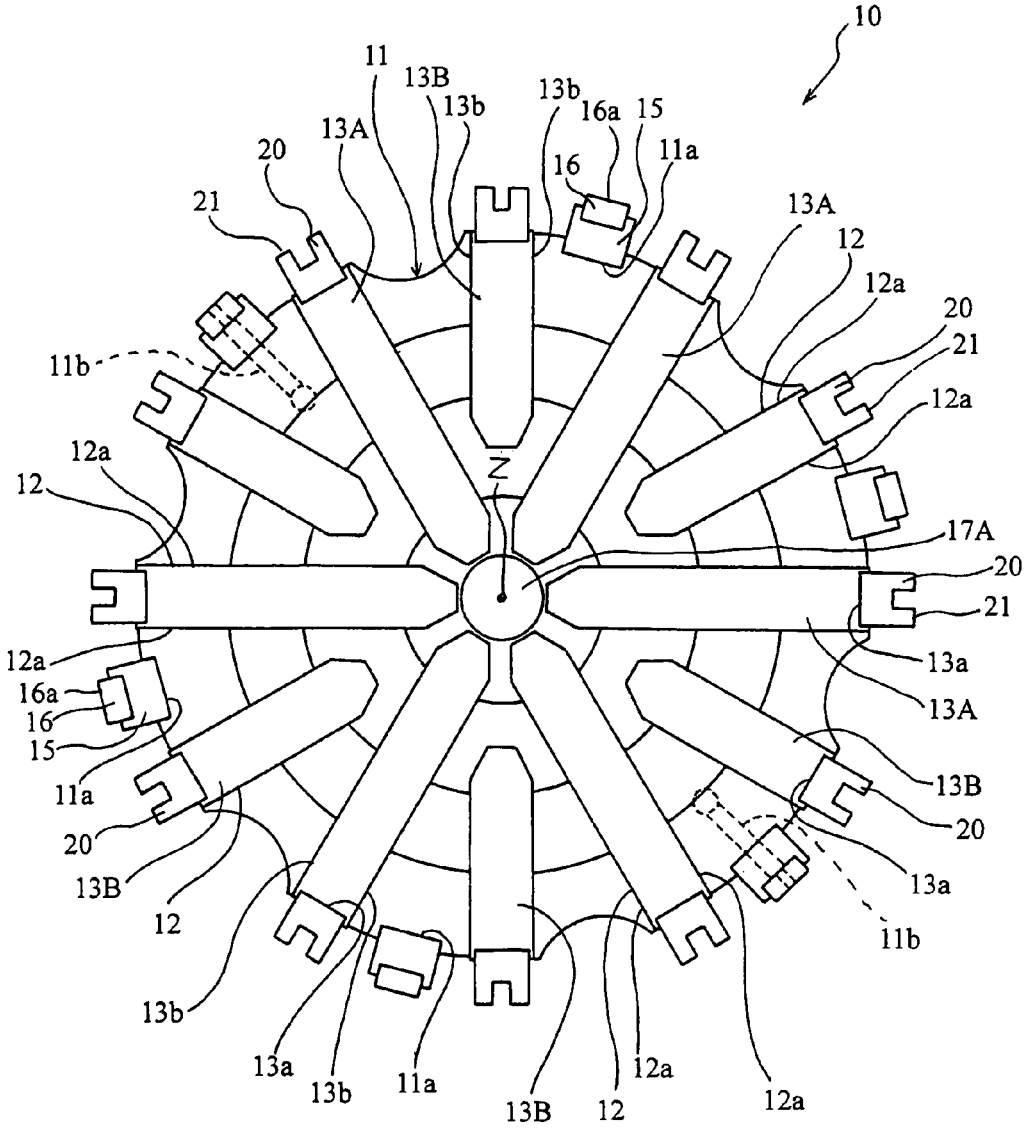
FIG. 3 is a diagram of the honing tool in FIG. 2 viewed in a direction of arrow A in FIG. 2.

FIG. 3 is a diagram for showing a view of the honing tool 10 seen in a direction of arrow A in FIG. 2. As shown in FIGS. 2 and 3, the honing tool 10 includes a honing tool main body 11 in the form of a hollow cylinder. The upper end of the main body 11 is supported on the honing head 1. On the outer periphery of the honing tool main body 11, a plurality of honing shoe guide openings, for instance 12 openings, are provided with equal intervals therebetween. Each of the guide openings extends from the outer periphery of the main body 11 to the axis X when viewed from an end of the main body 11. Each of the guide openings also vertically extends along the entire length of the axis X. First honing shoes 13A and second honing shoes 13B are alternately and radially arranged so as to fit in the guide openings. The honing shoes 13A and 13B slide in two directions, that is towards and away from the axis Z, under the guidance of the guide openings 12.

The first and second honing shoes 13A and 13B are in the form of blocks. Each of the blocks has a wheel fitting groove 13*a* at the outer end with respect to the radial direction of the honing tool 10. The wheel fitting grooves 13*a* at the outer end of the shoes 13A and 13B extend along the lengthwise direction of the axis Z. The honing shoes 13A and 13B have lateral faces 13*b* which contact lateral walls 12*b* of the honing shoe guide openings 12. Furthermore, engaging grooves 13*c* and 13*d* are formed respectively on an upper end and a lower end of the outer peripheries of the honing shoes 13A and 13B (FIG. 2).

The first honing shoe 13A has an inner edge including an upper inner edge and a lower inner edge. The upper inner edge and lower inner edges respectively have an upper taper surface 13Aa and a lower taper surface 13Ab. Each of the taper surfaces 13Aa and 13Ab are gradually inclined so that that a horizontal distance between the upper part of the taper surface 13Aa or 13Ab and the axis Z is longer than that between the lower part of the taper surface 13Aa or 13Ab and the axis Z. Likewise, the second honing shoe 13B has an inner edge including an upper inner edge and a lower inner edge. The upper inner edge and lower inner edges respectively have an upper taper surface 13Ba and a lower taper surface 13Bb. Each of the taper surfaces 13Ba and 13Bb are gradually inclined so that that a horizontal distance between the upper part of the taper surface 13Ba or 13Bb and the axis Z is longer than that between the lower part of the taper surface 13Ba or 13Bb and the axis Z. Spring bands 13*a* and 14*b* in the form of rings are inserted to the engaging grooves 13*c* and 13*d* formed in the honing shoes 13A and 13B as diameter-minimizing force urging members. The first and second honing shoes 13A and 13B are pressed by the spring bands 13*a* and 14*b* toward the axis Z. Namely, the honing shoes 13A and 13B are urged by the bands 13*a* and 14*b* to form an aggregate having a small diameter.

The honing stones 20 (wheels) in the form of blocks, which extend in a direction of the rotational axis Z of the honing tool 10, are provided in the wheel fitting grooves 13*a* in the first and second honing shoes 13A and 13B. The honing stones 29 are metal bond wheels including particles made of diamond, CBN (cubic boron nitride), crystalline aluminum oxide, silicone carbide or the like, and an electroconductive connection made of bronze and cast iron for combining the particles with each other.

Furthermore, a plurality of honing guide member installation grooves 11*a* are provided on the outer periphery of the honing tool main body 11 at equal intervals, and extend in a lengthwise direction of the axis Z. Honing guide members 16 in the form of rectangles are made of a material such as ceramics, and extend in a lengthwise direction of the axis Z. The honing guide members 16 are provided in the grooves 11*a* via attachments 15. The distances from the axis Z to outer peripheral surfaces 16*a* of the honing guide members 16 are identical. Air passages 11*b* are perforated in the honing tool main body 11 and extend to the outer peripheral surfaces 16*a* of the honing guide members 16 to form openings thereon. The air passages 11*b* are provided for precisely measuring the distance (space) between the outer peripheral surface 16*a* of the honing guide member 16 and a grinding surface of a workpiece, by using an air micrometer (not shown). The space is measured by the value of the air pressure.

A first bar 17A for outwardly pressing the honing shoes 13A is provided in the honing tool main body 11 so as to vertically penetrate the main body 11. As the cross section in FIG. 2 shows, the first bar 17A has an upper taper surface 17Aa and a lower taper surface 17Ab, each having an inclination which tapers toward a lower part of the first bar 17A. Namely, a horizontal distance between lower parts of the taper surfaces to the axis Z is smaller than that between upper parts of the taper surfaces to the axis Z. The upper taper surface 17Aa and the lower taper surface 17Ab of the bar 17A slide on the upper taper surfaces 13Aa and the lower taper surfaces 13Ab of the honing shoes 13A, respectively.

A second bar 17B for outwardly pressing the honing shoes 13B is also provided in the honing tool main body 11 and is connected to first bar 17A. The second bar 17B has an upper taper surface 17Ba and a lower taper surface 17Bb, each having an inclination which tapers toward a lower part of the second bar 17B. Namely, a horizontal distance between lower parts of the taper surfaces and the axis Z is smaller than that between upper parts of the taper surfaces and the axis Z. The upper taper surface 17Ba and the lower taper surface 17Bb of the bar 17B slide on the upper taper surface 13Ba and the lower taper surface 13Bb of the honing shoes 13B, respectively.

The first bar 17A and the second bar 17B are pulled by traction of an ascent-and-descent mechanism (not shown) provided in the honing head 1, and the traction is released. A spring 18 provided in the honing tool main body 11 always impart a force in a lower direction with respect to the main body 11 to the first and second bars 17A and 17B.

When the traction provided by the ascent-and-descent mechanism in the honing head 1 is released, the first bar 17A moves downwardly and the upper taper surface 17Aa and the lower taper surface 17Ab of the first bar 17A are brought into pressure contact with the upper taper surfaces 13Aa and the lower taper surfaces 13Ab of the first honing shoes 13A, due to the urging force of the spring 18. Accordingly, the first bar 17A thrusts the first honing shoes 13A outwardly with respect to the diameter of the honing tool 10, so that the first honing shoes 13A moves away from the axis Z. Likewise, when the second bar 17B moves downwardly, the upper and lower taper surfaces 17Ba and 17Bb of the first bar 17B are brought into pressure contact with the upper taper surfaces 13Ba and the lower taper surfaces 13Bb of the first honing shoes 13B. Accordingly, the first bar 17B thrusts the first honing shoes 13B outwardly with respect to the diameter of the honing tool main body 11, so that the first honing shoes 13B moves away from the central axis Z.

When the first and second bars 17A and 17B are pulled upwardly by the ascent-and-descent mechanism, opposing the force applied by the spring, the pressure application, that is to the upper taper surfaces 13Aa and the lower taper surfaces 13Ab of the first honing shoes 13 by the upper taper surface 17Aa and the lower taper surface 17Ab of the first bar 17A, is eliminated. After the pressure application by the first and second bars 17A and 17B is released, the first and second honing shoes 13A and 13B move toward the axis Z, due to the urging force of the spring bands 14*a* and 14*b*. Thus, the honing shoes 13A and 13B are gathered to be an aggregate with a small diameter.

Insulation treatment is applied to a portion between the honing head 1 and the first and second bars 17A and 17B of the honing tool 10. As shown in FIG. 2, the honing tool main body 11 is provided with an electrode 39. The electrode 39 is connected to the honing stones 20 via the honing tool main body 11, the first and second honing shoes 13A and 13B so that electricity is conductive between the electrode 39 and the honing stones 20.

When the honing tool main body 11, the first and second bars 17A and 17B are made of electroconductive iron materials and rust develops thereon, due to the electrolytic dressing (will be discussed later), the sliding movement of the first and second honing shoes 13A and 13B with respect to the honing shoe guide openings 12 could be inactive, i.e., the smooth movement could be lost. For preventing the inactive movement, it is preferable to prepare the first and second honing shoes 13A and 13B from an electroconductive and antioxidant material, such as stainless steel. It is also preferable to use O rings made of materials having antioxidant properties, such as stainless steel or a rubber, as spring bands 14*a* and 14*b*. Furthermore, it is preferable to apply insulating coatings (paints) to the outer surface of the honing tool main body 11, for rust prevention purpose. On the other hand, when the honing tool main body 11, and the first and second bars 17A and 17B are made of iron materials, the manufacturing cost can be lowered. Furthermore, the main body 11, and the bars 17A and 17B made of iron are widely applicable to the existing honing apparatus.

Figure 4:
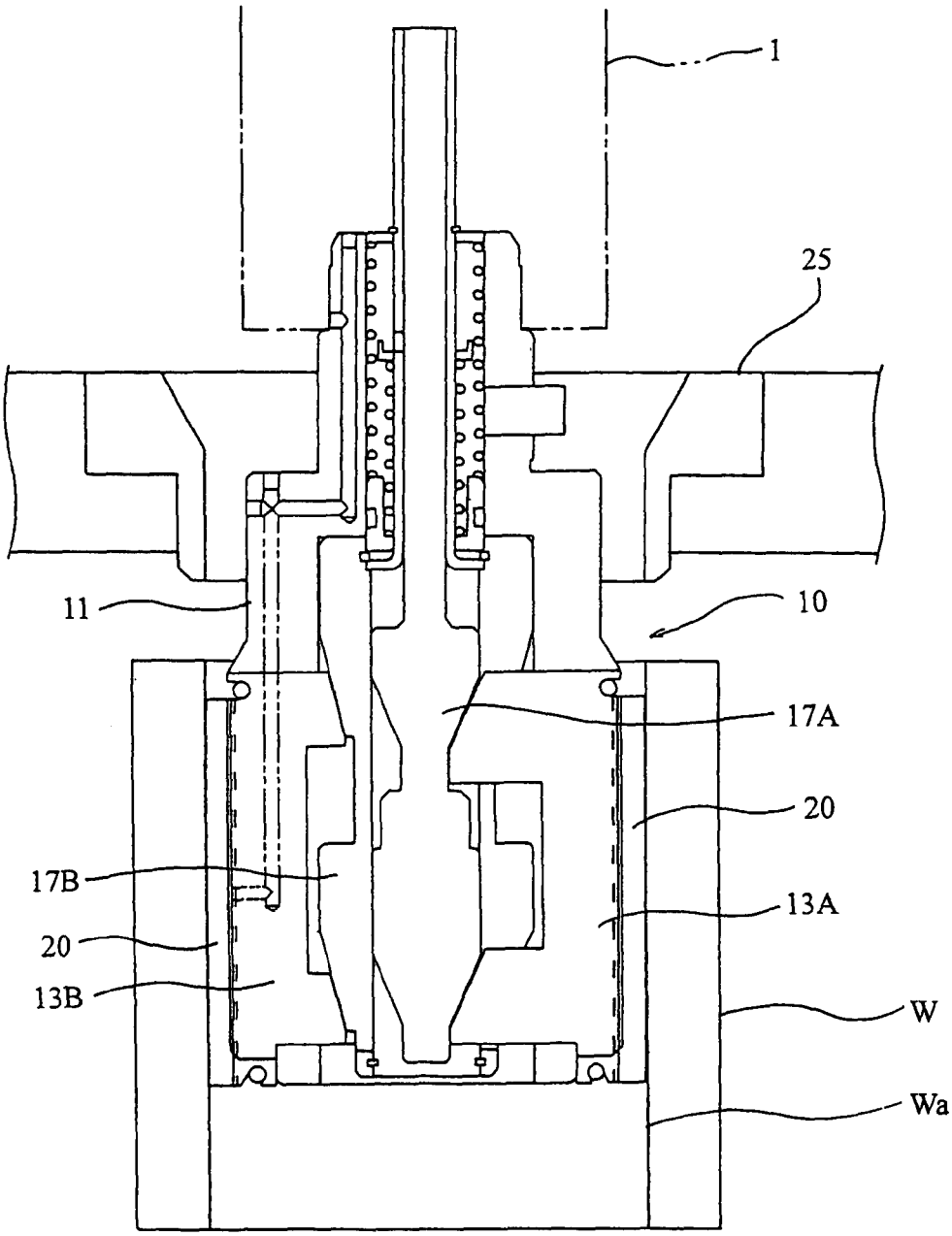
FIG. 4 is a schematic diagram of a processing unit.

FIG. 4 is a diagram for showing a processing unit I for applying a honing treatment to a cylindrical inner surface Wa of the workpiece W. The processing unit I is provided with a workpiece support (not shown) for positioning and holding the workpiece W, and an insertion guide 25 in the form of a hollow cylinder provided above the workpiece W. The insertion guide 25 guides the introduction of the honing tool main body 11 therein, which descends from an upper part, into the workpiece supported by the workpiece support. Therefore, the main body is surrounded by the cylindrical inner surface Wa of the workpiece W. The processing unit I further includes a honing liquid supply member for supplying a honing liquid with a small electroconductive or substantially no electroconductive property such as an oil coolant to the cylindrical inner surface Wa of the workpiece W. In the processing unit I, honing finishing is carried out by using the honing liquid with a small electroconductive or substantially no electroconductive property.

In the processing unit I, the workpiece W is supported by the workpiece support. Then, the ascent-and-descent mechanism in the honing head 1 pulls the first and second bars 17A and 17B of the honing tool 10 in an upper direction. By the pulling operation, the first and second honing shoes 13A and 13B moves towards the central axis Z of the honing tool 10. Namely, the honing tool 10 has the honing shoes 13A and 13B in a aggregate state (centralized). The honing tool 10 in this state located above the workpiece W is brought down by the guidance of the insertion guide 25, and then put inside of the cylindrical inner surface Wa of the workpiece W. With maintaining the honing tool main body 11 inside the cylindrical inner surface Wa, the honing liquid with substantially no electroconductive property such as an oil coolant is supplied. Simultaneously with the honing liquid supply, the honing tool 10 is moved in vertical directions along the axis Z and also caused to rotate therearound. Subsequently, the traction of the first and second bars 17A and 17B of the honing tool 10 by the ascent-and-descent mechanism is released.

After the release of the traction, the first and second bars 17A and 17B move downwardly due to the urging force of the spring 18. Then, the upper taper surface 17Aa and the lower taper surface 17Ab of the first bar 17A are brought into pressure contact with and slide on the upper taper surfaces 13Aa and the lower taper surfaces 13Ab of the honing shoes 13A, respectively. Accordingly, the first honing shoes A are pushed to be away from the central axis Z (spread). In other words, the first honing shoe moves in radially outward directions of the honing tool 10. In addition to the above, the upper taper surface 17Ba and the lower taper surface 17Bb of the second bar 17B are brought into pressure contact with and slide on the upper taper surfaces 13Ba and the lower taper surfaces 13Bb of the honing shoes 13B, respectively. Then, the second honing shoes 17A are pushed to be away from the central axis Z.

By the above operation, the outer surfaces 21 of the honing stones 20 contact the cylindrical inner surface Wa of the hollow workpiece W. The grinding operation (honing treatment) on the cylindrical inner surface Wa is started with the honing stones 20 by the application of a predetermined contact pressure to the cylindrical inner surface Wa.

During the honing treatment, the space between the outer peripheral surface 16*a* of the honing guide member 16 and the cylindrical inner surface Wa of the workpiece W is detected by a micrometer. When the micrometer detects that a predetermined space is obtained between the outer peripheral surface 16*a* of the honing guide member 16 and the cylindrical inner surface Wa of the workpiece W, the ascent-and-descent mechanism pulls the first and second bars 17A and 17B upwardly, the upper and lower taper surfaces 13Aa and 13Ab of the first honing shoes 13A are detached from the upper and lower taper surfaces 17Aa and 17Ab of the first bar 17A, and also the upper and lower taper surfaces 13Ba and 13Bb the second honing shoes 13B are released from the pressure application by the upper and lower taper surfaces 17Ba and 17Bb of the second bar 17B. Therefore, the first and second honing shoes 13A and 13B are moved in the direction of the axis Z by the force of the spring bands 14*a* and 14*b*. Namely, the honing shoes 13A and 13B are moved away from the inner cylindrical surface Wa of the workpiece W, that is, a treating surface of the honing stones. Thus, the honing treatment is completed. The period from the start of the honing treatment to the completion thereof is referred to as processing period.

When the honing treatment is completed, the rotational movement and the vertical movement of the honing tool 10 are suspended. By moving the honing head 1 upwardly, the honing tool main body 11 is taken away from the location within the inner surface Wa of the workpiece W and transferred to a location above the insertion guide 25. Thereafter, the workpiece W after the honing treatment is removed from the workpiece support, and the next workpiece is brought to the workpiece support. In other words, the workpieces are sent in and out in a time period between the completion of the honing treatment and the next commencement of the honing treatment (non-processing period).

As is obvious from the above, workpieces W are successively subjected to the honing treatment by repeating the processing period and the non-processing period being carried out in turn.

Figure 6:
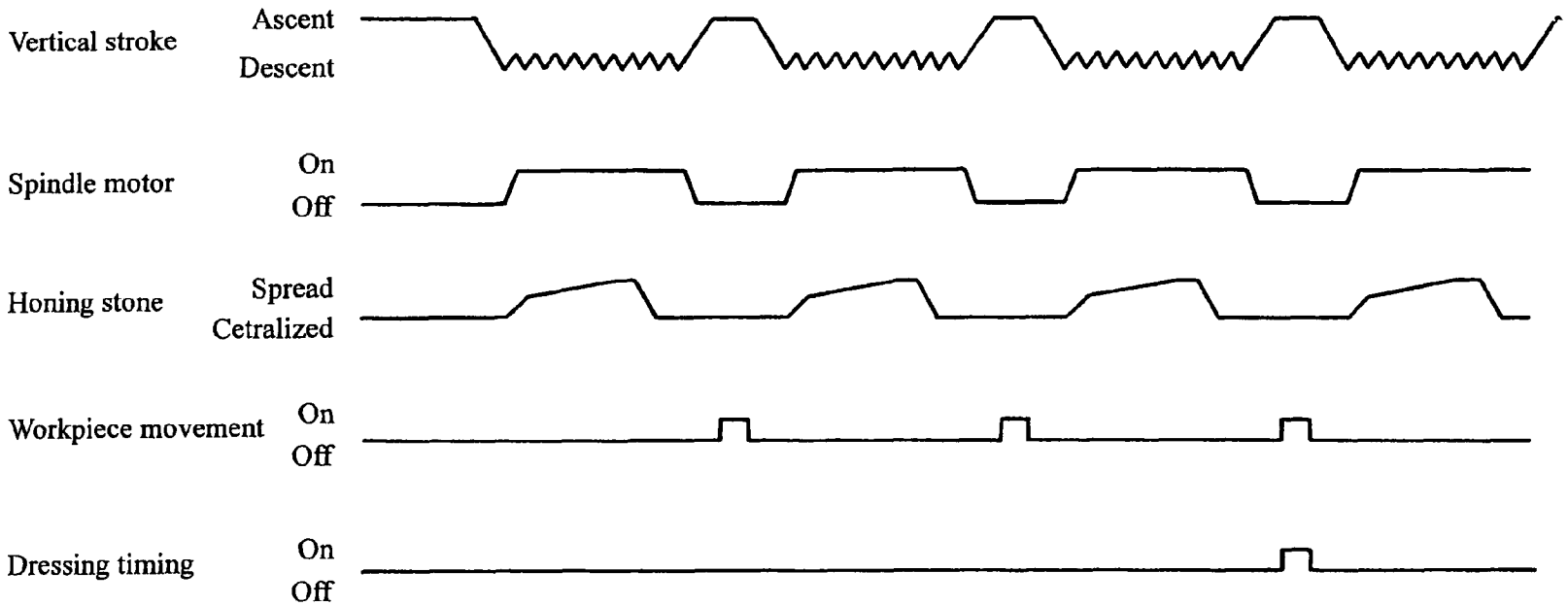
FIG. 6 is a chart for explaining a grinding operation.
Figure 7:
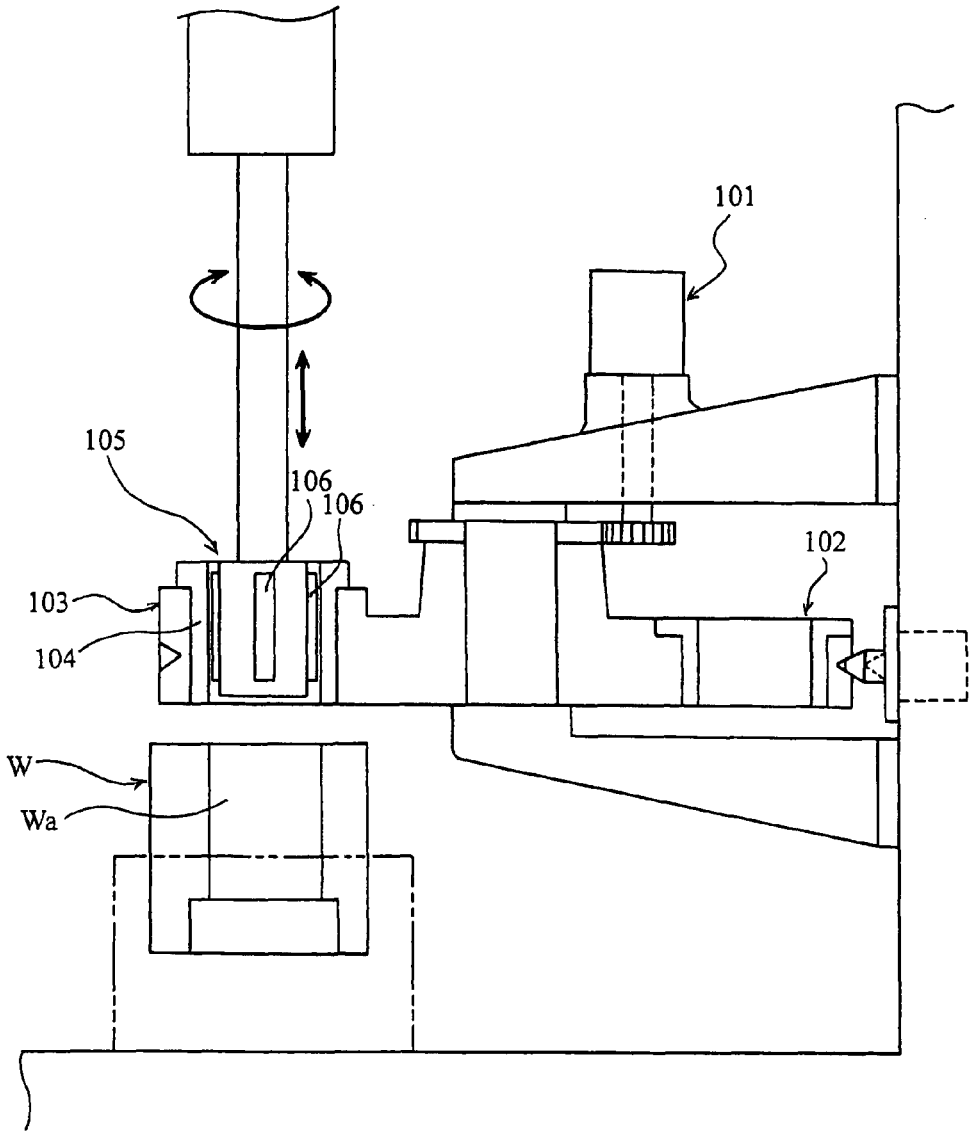
FIG. 7 is a schematic diagram of a conventional apparatus for applying a dressing treatment to a honing stone.
Figure 8:
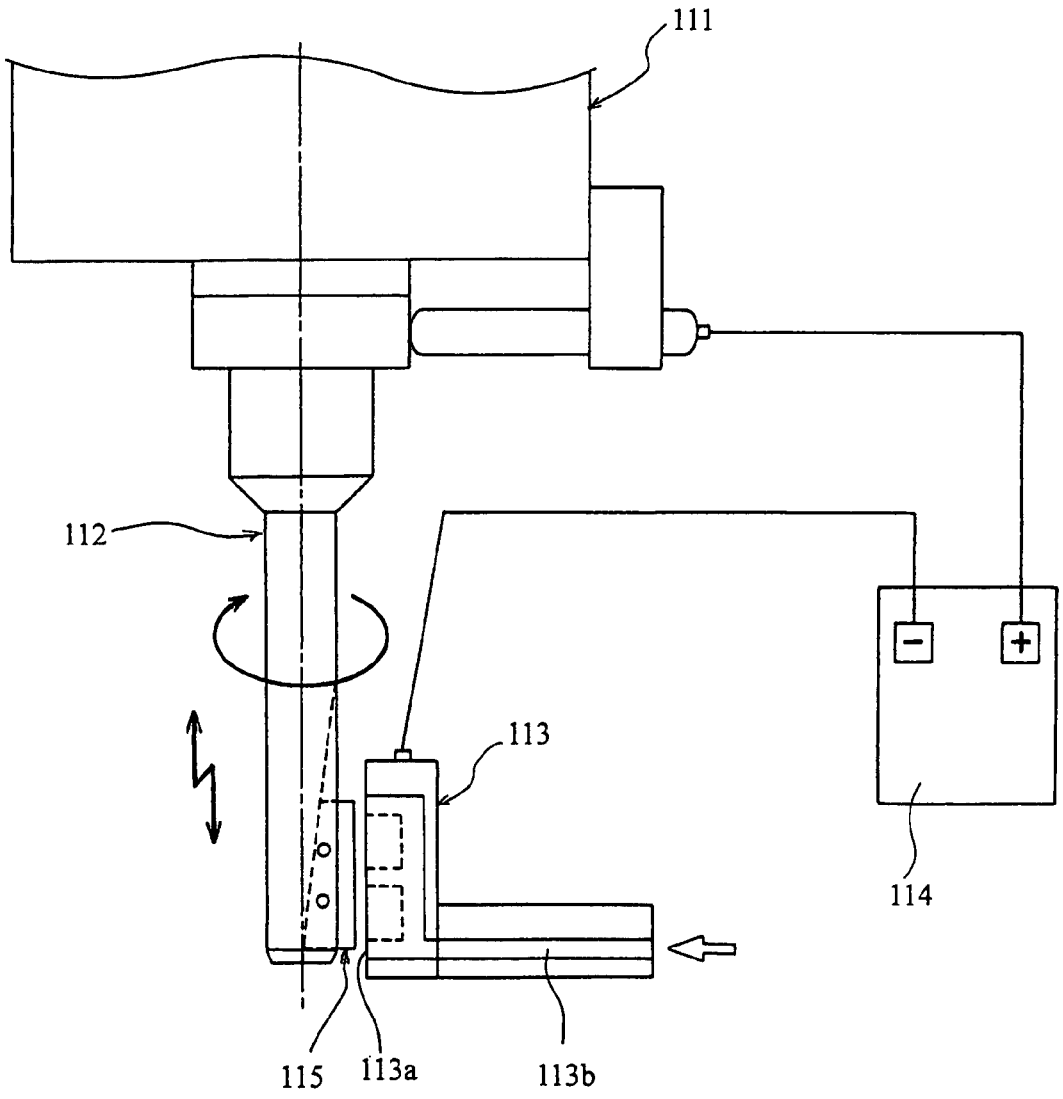
FIG. 8 is a schematic diagram of a conventional apparatus for applying an electrolytic dressing treatment to a honing stone.
Figure 9:
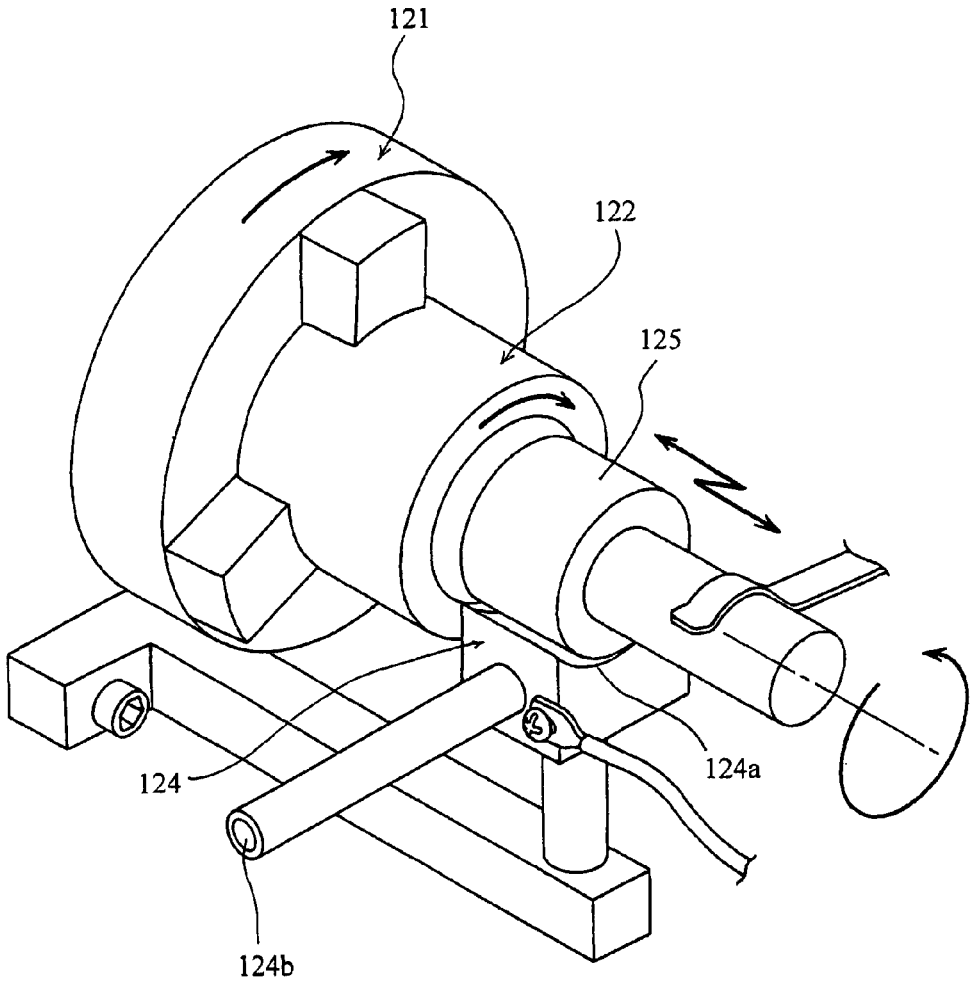
FIG. 9 is a schematic diagram of a conventional apparatus for applying an electrolytic dressing treatment to a honing stone.

FIG. 6 is a time chart for showing a honing processing cycle. Time is taken at the abscissa in FIG. 6. The line labeled as "Vertical Stroke" indicates the ascent and decent movement of the honing tool 10 provided on the honing head 1. The line labeled as "Spindle Motor" shows that "On" and "Off" of a spindle motor, and correspondingly "On" and "Off" of the rotational movement of the honing head 1 and honing tool 10. The line labeled as "Honing Stones" shows that the movement of the honing stones 20 to the "Spread" and "Centralized" positions as described above. Furthermore, the line labeled as "Workpiece movement" describes that the timing of sending workpieces in and out, with respect to the processing unit I. When the workpiece movement is "On", the honing head is in an ascent position and the workpieces are sending in and out. Namely, a finished workpiece is replaced by a next workpiece to be ground when the movement is "On". On the other hand, the workpieces are not sending in and out, when honing operation is carried out in the processing unit I. This situation is described as "Off".

After the honing treatment including the processing period and non-processing period are repeatedly carried out in turn, the grinding capability of the honing stones 20 is gradually lowered because of the abrasion of grinding particles in the honing stones. Correspondingly, the processing period is getting longer. In the present invention, a processing period measuring member is provided for measuring the processing period. When the processing period arrives at a predetermined threshold value, the grinding capability is considered to be lowered to a predetermined level due to the abrasion of the grinding particles in the honing stones. Then, the electrolytic dressing treatment is applied to the honing stones 20 during the non-processing period, for maintaining an operational preciseness.

Figure 5:
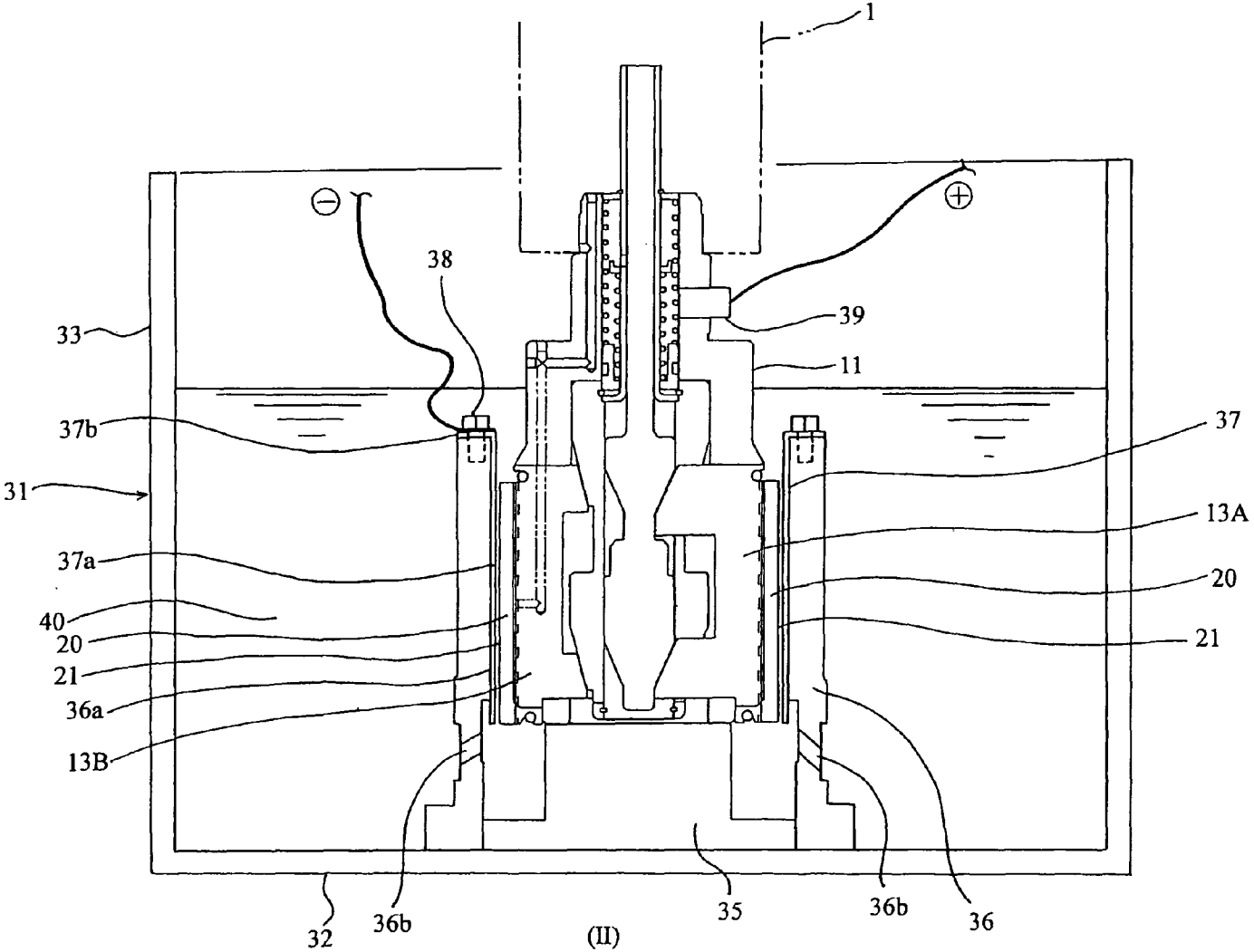
FIG. 5 is a schematic diagram of the electrolytic dressing unit.

FIG. 5 is a diagram for showing an electrolytic dressing unit II for applying an electrolytic dressing treatment to the honing stones 20 of the honing tool 10.

The electrolytic dressing unit II includes a vessel 31 for storing a grinding liquid having an excellent electroconductivity, such as a aqueous coolant 40. The vessel 31 includes a bottom 32 and a wall 33 extending from the periphery of the bottom 32, and the top part of the vessel 31 is open. The honing tool 10 is provided in the vessel 31, with the bottom of the honing tool 10 being placed on the bottom 32 of the vessel 31. A honing tool supporting member 35 which is for positioning the honing tool 10 is provided on the bottom 32. The honing tool supporting member 35 is made of an insulating material.

Furthermore, an electrode supporting member 36 in the form of a hollow cylinder is vertically provided on the bottom 32. The vertical wall of the electrode supporting member 36 surrounds the honing tool supporting member 35. The supporting member 36 is made of an insulating material, with the top part thereof being open. The electrode supporting member 36 has a height lower than the liquid level of the aqueous coolant 40 in the vessel 31. A plurality of though-openings 36*b* are perforated in the peripheral wall of the electrode supporting member 36 for maintaining the flow of the aqueous coolant 40 through the peripheral wall.

An electrode 37 for electrolytic in-process dressing (hereinafter, referred to as ELID) is provided on the electrode supporting member 36. The electrode 37 has a cylindrical electrode surface 37*a* and a flange 37*b*. The electrode surface 37*a* extends along an inner surface 36*a* of the electrode supporting member 36. The flange is fixed to a top end of the electrode supporting member 36 by bolts as terminals 38. The electrode 37 is made, for instance, of iron, and the terminals 38 are connected to a negative electrode (minus electrode) of a voltage application member (not shown).

The electrode 37 for ELID in the form of a hollow cylinder is provided along the inner surface 36*a* of the cylindrical electrode supporting member 36. The electrode 37 accepts the honing tool main body 11 and the honing stones 20 by surrounding these by the surface 37*a*, when the honing tool main body 11 and the honing stones 20 are brought down by the honing head 1. Hence, the surface 37*a* of the electrode 37 faces the outer surfaces 21 of the honing stones 20, with a space therebetween. The honing stones 20 are provided on the honing tool 10 which is positioned and supported by the honing tool supporting member 35. The cylindrical electrode 37 has an inner diameter for having a distance in the range of about 1 mm to about 5 mm between the inner surface 37*a* of the electrode and the outer surfaces 21 of the honing stones 20. Moreover, the vertical length of the electrode 37 is slightly larger than the lengths of the honing stones 20.

The honing tool 10 is transferred from the processing unit I to a position above the honing tool supporting member 35 in the electrolytic dressing unit II, following the movement of the honing head 1. Then, the honing tool 10 is moved downwardly and inserted to a region surrounded by the electrode supporting member 36, and properly positioned on the honing tool supporting member 35. By the positioning of the honing tool 10 by the honing tool supporting member 35, the outer surfaces 21 of the honing stones 20 face the surface 37*a* of the electrode 37*a* for ELID, with the aqueous coolant (electroconductive liquid) 40 being provided around the outer surface 21 of the honing stones 20. Following the upward movement of the honing head 1, the honing tool 10 is removed from the electrode supporting member 36 and moves upwardly. Then, the honing tool 10 is returned to the processing position I by the movement of the honing head 1.

On the other hand, the honing tool 10 is moved from the processing unit I to a location above the honing tool supporting member 35 in the electrolytic dressing unit II. The honing tool 10 is configured to connect a positive electrode (plus electrode) of the voltage application member to the electrode 39 of the honing tool main body 11, and to disconnect therefrom when the honing tool 10 is transferred to the processing unit I.

After the honing tool 10 is transferred to a location above the honing tool supporting member 35 of the electrolytic dressing unit II based on the movement of the honing head 1, the electrode 39 provided on the honing tool main body 11 of the honing tool 10 is connected to the positive electrode of the voltage application member.

The honing head 1 is moved downwardly along the axis Z with maintaining the connection of the electrode 39 with the positive electrode of the voltage application member. Therefore, the honing tool 10 is also moved downwardly and inserted to a position within the electrode supporting member 36, so as to be positioned and supported on the honing tool supporting member 35. The honing tool 10 appropriately positioned on the honing tool supporting member 35 faces the electrode surface 37*a* of the electrode 37 for ELID, having an aqueous coolant (electroconductive liquid) around the outer surfaces 21 of the honing stones 20.

In this state, the negative voltage is applied from an electrical source for ELID to the electrode 37 for ELID, exclusively for the predetermined dressing period. Simultaneously, a positive voltage is applied from the voltage application member to the honing stones 20 by way of the electrode 39, honing tool main body 11, and honing shoes 13A and 13B. Accordingly, the electroconductive connections in the honing stones 20 on the outer surfaces 21 are dissolved by the electrolytic operation. Thus, the electrolytic dressing of the present invention is carried out. The electrolytic dressing is performed in a stable condition because the aqueous coolant 40, provided between the electrode surface 37*a* and the outer surfaces 21 of the honing stones 20, has an excellent electroconductive property. The time period for electrolytic dressing can be appropriately adjusted, depending on the voltage for the electrolysis, protrusion degree of the grinding particles, and a material used as the electroconductive connection in the honing stones 20. For example, it is possible to preset the time period of several seconds. It is also possible to optimize the protrusion degree of the grinding particles, by appropriately selecting the voltage for the electrolysis and the period for performing electrolytic dressing.

When the electrolytic dressing of the honing stones 20 is completed, the honing tool 10 is moved upwardly from the electrode supporting member 36, and brought back to the processing unit I by the movement of the honing head 1. When the electrode 36 of the honing tool 10 is transferred to the processing unit I, the electrode 39 of the honing tool 10 is detached from the positive electrode of the ELID electrical source. The time period required for the electrolytic dressing is short and will never adversely affect the smooth operation of the honing treatments. The dressing timing is shown by the line labeled as "Dressing Timing" in FIG. 6.

In the embodiment of the present invention, a honing liquid having substantially no electroconductive property such as an oily coolant is used in the processing unit I in the course of repeatedly performing the honing treatment by using the honing tool 10. When the predetermined processing time exceeds a predetermined time as a threshold value and the grinding capability is decreased because of the abrasion of the honing stones 20, the honing tool 10 is moved to electrolytic dressing unit II. Therein, the honing stones 20 are subjected to the electrolytic dressing with an aqueous coolant having an excellent electroconductivity. It is possible in the present invention to carry out an electrolytic dressing even when the workpieces are ground with the application of a honing liquid having small or substantially no electroconductive property. As a result, the honing treatment is performed in a stable manner, and honing stones 20 with excellent quality can be obtained, without generating surface roughness dispersion. Moreover, it is possible to prevent the honing stones 20 from an excessive abrasion. Hence, the honing treatment is carried out with an improved efficiency and the processing period is shortened.

Moreover, in the present invention, the electrolytic dressing is carried out in an electrolytic dressing unit II with maintaining the honing tool 10 on the honing head 1, and the workpieces are transferred in the processing unit I and transferring out therefrom within an extremely short period of time. Therefore, the honing treatment is carried out without adversely affecting the entire length of honing operation.

Further, the aqueous coolant used in the present invention is easy to handle, and is widely used without imparting an adverse effect to the honing tool.

As to the determination of dressing timing, the grinding resistance gradually of the honing stones 20 increases, as the abrasion of the honing stones 20 progresses. By utilizing this phenomenon, the electrolytic dressing treatment can be applied to the honing stones when the grinding resistance exceeds a predetermined threshold value.

It is also possible to perform a dressing treatment with respect to the honing stones once after a predetermined number of the non-processing periods has elapsed. Consequently, products with an excellent quality can be prepared by the honing operation, wherein excessive deterioration of the grinding capability of the honing stones is eliminated. In other words, a series of processing periods can be effectively carried out within a shortened processing time, by preventing the honing stones from an excessive abrasion.

Furthermore, the electrolytic dressing of the present invention is applicable to any kind of wheels as long as the wheels can be treated by an electrolytic dressing. The process and the apparatus of the invention are applicable to other technologies including super finishing, where workpieces are ground with a honing liquid with a small or non electroconductive property, and the honing stones are made of grinding particles and an electroconductive connection therefor.

As the electroconductive liquid for the electrolytic dressing, many kinds of electroconductive grinding liquids can be used, in addition to the aqueous coolant.

The present invention being thus described, it will be clearly understood that the same may be varied in many ways. Such variations are not to be regarded as a departure from the spirit and scope of the present invention, and all such modification as would be easily understood to one skilled in the art are intended to be included within the scope of the appended claims.

What is claimed is:

1. A process for grinding workpieces, comprising:

attaching honing stones to a tool, each of the honing stones comprising grinding particles and an electroconductive connection for fixing the grinding particles to each other;

grinding the workpieces with the honing stones by applying a honing liquid having substantially no electroconductive property to a region between the workpiece and the honing stones, the workpieces being successively ground during a series of processing periods, while interposing non-processing periods between the processing periods, each of the workpieces being ground in one of the processing periods; and performing an electrolytic dressing with respect to the honing stones by using an electrode provided to face the honing stones with a space therebetween, a voltage being applied between the honing stones and the electrode in the presence of an electroconductive liquid in the space between the honing stones and the electrode, the electrolytic dressing being carried out during the non-processing periods, wherein the step of performing an electrolytic dressing includes submerging the tool in a bath of the electroconductive liquid.

2. The process for grinding workpieces as claimed in claim 1, wherein the electroconductive liquid is an aqueous coolant.

3. The process for grinding workpieces as claimed in claim 1, wherein the step of grinding the workpieces includes measuring a space between a surface on the tool and an inner surface on the workpiece, and, when it is determined that the measured space is equal to a predetermined space, stopping the grinding of the workpiece.

4. The process for grinding workpieces as claimed in claim 1, wherein during the step of grinding the workpieces, measuring the duration of the processing periods for grinding a workpiece, and, when the duration of a processing period is determined to be equal to or greater than a predetermined time, performing an electrolytic dressing step during a non-processing period before performing a next processing period.

5. A process for grinding workpieces, comprising:

providing an apparatus comprising:

a tool provided with honing shoes and honing stones, each of the honing stones comprising grinding particles and a connection for fixing the grinding particles to each other, wherein the honing shoes are arranged on the tool to be slidably movable in a radial direction of the tool, and the honing stones are positioned on surfaces of the honing shoes;

a processing unit including a workpiece support for supporting the workpieces, and a honing liquid supply member for supplying a honing liquid having substantially no electroconductive property; and an electrolytic dressing unit including a vessel for storing an electroconductive liquid, an electrode and a voltage application member, the electrode and the voltage application member provided in the vessel and facing each other with a space therebetween, the voltage application member applying a voltage to the honing stones;

grinding the workpieces with the honing stones by applying a honing liquid having substantially no electroconductive property to a region between the workpiece and the honing stones, the workpieces being successively ground during a series of processing periods in the processing unit, the processing periods interposing non-processing periods therebetween, each of the workpieces being ground in one of the processing periods; and performing an electrolytic dressing with respect to the honing stones by applying a voltage between the honing stones and the electrode in the presence of the electroconductive liquid in the space between the honing stones and the electrode, the electrolytic dressing being carried out during the non-processing periods in the electrolytic dressing unit.

6. The process for grinding workpieces as claimed in claim 5, wherein the electroconductive liquid is an aqueous coolant.

7. The process for grinding workpieces as claimed in claim 5, wherein the step of grinding the workpieces includes measuring a space between a surface on the tool and an inner surface on the workpiece, and, when it is determined that the measured space is equal to a predetermined space, stopping the grinding of the workpiece.

8. The process for grinding workpieces as claimed in claim 5, wherein the step of performing an electrolytic dressing includes submerging the tool in a bath of the electroconductive liquid.

9. The process for grinding workpieces as claimed in claim 5, wherein during the step of grinding the workpieces, measuring the duration of the processing periods for grinding a workpiece, and, when the duration of a processing period is determined to be equal to or greater than a predetermined time, performing an electrolytic dressing step during a non-processing period before performing a next processing period.

10. An apparatus for grinding workpieces, comprising:

a tool provided with honing shoes and honing stones, each of the honing stones comprising grinding particles and a connection for fixing the grinding particles to each other, wherein the honing shoes are arranged on the tool to be slidably movable in a radial direction of the tool, and the honing stones are positioned on surfaces of the honing shoes;

a processing unit including a workpiece support for supporting the workpieces, and a honing liquid supply member for supplying a honing liquid with substantially no electroconductive property, wherein the apparatus is adapted to grind workpieces with the honing stones by applying the honing liquid to a region between the workpiece and the honing stones, the workpieces being successively ground during a series of processing periods in the processing unit, the processing periods interposing non-processing periods therebetween, each of the workpieces being ground in one of the processing periods; and an electrolytic dressing unit including a vessel for storing an electroconductive liquid, an electrode and a voltage application member, the electrode and the voltage application member provided in the vessel and facing each other with a space therebetween, wherein the voltage application member is adapted to apply a voltage to the honing stones, and the apparatus is adapted to perform an electrolytic dressing with respect to the honing stones by applying a voltage between the honing stones and the electrode in the presence of the electroconductive liquid in the space between the honing stones and the electrode, the electrolytic dressing being carried out during the non-processing periods in the electrolytic dressing unit.

11. The apparatus for grinding workpieces as claimed in claim 10, further comprising a processing period measuring member for measuring the lengths of the processing periods, the electrolytic dressing being applied to the honing stones when the processing period measuring member detects that the lengths of the processing periods reach a predetermined threshold value.

12. The apparatus for grinding workpieces as claimed in claim 10, wherein the electrolytic dressing is performed once after a predetermined number of the non-processing periods has elapsed.

13. The apparatus for grinding workpieces as claimed in claim 10, wherein the tool is a honing tool including a rotatable honing tool main body configured to be supported by a vertically movable honing head, and the honing stones are configured as radially arranged rectangular rods provided on outer peripheral surfaces of the honing shoes; and the electrode is configured as a hollow cylinder to receive the honing tool main body and the honing stones therein when the honing tool main body is moved downwardly by the support of the honing head, the honing stones facing a cylindrical surface of the electrode with a predetermined space extending from the honing stones to the cylindrical surface.

14. The apparatus for grinding workpieces as claimed in claim 13, wherein the honing tool main body is made of an iron material.

15. The apparatus for grinding workpieces as claimed in claim 13, wherein the honing tool further comprises a bar for pressing the honing stones outwardly, the honing tool main body being configured as a hollow cylinder having a cylindrical wall extending along the central axis of the honing tool, an upper part of the honing tool main body being configured to be supported by the honing head, the honing tool main body having a plurality of honing shoe guide openings in the cylindrical wall, the openings penetrating the cylindrical wall and radially extending when viewed from an end of the honing tool main body, and also vertically extending along the central axis of the honing tool main body, the honing shoes configured to fit in the openings in the cylindrical wall of the honing tool main body respectively and being slidable therein in radial directions, such that the bar is adapted to thereby press the honing shoes outwardly so as to move away from the central axis of the honing tool.

16. The apparatus for grinding workpieces as claimed in claim 15, wherein the honing shoes are made of stainless steel.

17. The apparatus for grinding workpieces as claimed in claim 10, wherein the electroconductive liquid is an aqueous coolant.

18. The apparatus for grinding workpieces as claimed in claim 10, wherein the honing tool further comprises air passageways formed in the tool for use with a micrometer for measuring a space between a surface on the tool and an infer surface on the workpiece, and a grinding process is stopped when the measured space is determined to be equal to a predetermined space.

19. The apparatus for grinding workpieces as claimed in claim 10, wherein the vessel of the electrolytic dressing unit is configured to store the electroconductive liquid as a bath of electroconductive liquid adapted for submersion of the tool therein.

20. The apparatus for grinding workpieces as claimed in claim 10, wherein the apparatus is configured to adjust a position of the tool between a first position for contacting and grinding a workpiece, and a second position for performing an electrolytic dressing to the tool.

* * * * *